US006615800B1

(12) United States Patent
Frank et al.

(10) Patent No.: US 6,615,800 B1
(45) Date of Patent: Sep. 9, 2003

(54) HIGH-PRESSURE FUEL RESERVOIR

(75) Inventors: Kurt Frank, Schorndorf (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/831,160

(22) PCT Filed: Aug. 18, 2000

(86) PCT No.: PCT/DE00/02820

§ 371 (c)(1),
(2), (4) Date: Aug. 20, 2001

(87) PCT Pub. No.: WO01/18385

PCT Pub. Date: Mar. 15, 2001

(30) Foreign Application Priority Data

Sep. 8, 1999 (DE) ..... 199 42 855

(51) Int. Cl.[7] ..... F02M 41/00; F02M 7/00
(52) U.S. Cl. ..... 123/456; 123/447
(58) Field of Search ..... 123/456, 447, 123/463, 468, 469, 470; 138/28, 30

(56) References Cited

U.S. PATENT DOCUMENTS 5,456,233 A * 10/1995 Felhofer ..... 123/447
5,575,262 A * 11/1996 Rohde ..... 123/467
5,617,827 A * 4/1997 Eshleman et al. ..... 123/456
5,730,506 A * 3/1998 Friedow et al. ..... 303/87
5,845,621 A * 12/1998 Robinson et al. ..... 123/456
5,896,843 A * 4/1999 Lorraine ..... 123/467
6,125,890 A * 10/2000 Cooper et al. ..... 138/131
6,314,942 B1 * 11/2001 Kilgore et al. ..... 123/467
6,390,131 B1 * 5/2002 Kilgore ..... 138/30

FOREIGN PATENT DOCUMENTS

DE 4006501 * 9/1991
JP 08261099 * 12/1994
JP 06346818 * 8/1996

* cited by examiner

*Primary Examiner*—Mahmoud Gimie
(74) *Attorney, Agent, or Firm*—Ronald E. Greigg

(57) ABSTRACT

The invention relates to a high-pressure fuel reservoir for a common rail fuel injection system of an internal combustion engine, having a plurality of connection openings, in particular connection openings for delivering and removing fuel and connection openings for sensors and valves and so forth. To increase the strength of the high-pressure fuel reservoir, the high-pressure fuel reservoir is equipped with a pulsation damping device.

10 Claims, 5 Drawing Sheets

HIGH-PRESSURE FUEL RESERVOIR

CROSS-REFERENCE TO RELATED APPLICATIONS

This application is a 35 USC 371 application of PCT/DE 00/02820 filed on Aug. 8, 2000.

BACKGROUND OF THE INVENTION

1. Field of the Invention

The invention relates to a high-pressure fuel reservoir for a common rail fuel injection system of an internal combustion engine, having a plurality of connection openings, in particular connection openings for delivering and removing fuel and connection openings for sensors and valves and so forth.

2. Description of the Prior Art

In common rail injection systems for internal combustion engines, a high-pressure pump, optionally with the aid of a prefeed pump, pumps the fuel to be injected out of a tank into the central high-pressure fuel reservoir, which is called a common rail. From the rail, high-pressure lines lead to the individual injectors that are assigned one to each of the engine cylinders. The injectors are triggered individually by the engine electronics as a function of the operating parameters of the internal combustion engine, in order to inject fuel into the combustion chamber of the engine. By means of the high-pressure fuel reservoir, the pressure generation and the injection are decoupled from another.

A conventional high-pressure fuel reservoir is described in German Patent Disclosure DE 196 40 480, for instance. The known high-pressure fuel reservoir comprises an elongated, tubular body with a plurality of connections for supplying fuel injection valves, which are also called injectors. The tubular body has the simultaneous functions of pulsation damping over its volume and of distributing the fuel via the connections. Depending on the adaptation in the system, pressure pulsations occur, especially when the inside diameter of the tube is small and the length of the tube is great. The pressure pulsations mean that some injectors will inject too little, because of the development of a standing pressure wave. Pressure waves running back and forth in the rail can also mean that the injectors either in alternation or stochastically inject an overly small fuel quantity. To damp the pulsations in the rail, a relatively large volume is needed. The large volume makes it more difficult and expensive to design the rail to withstand high pressure.

OBJECTS AND SUMMARY OF THE INVENTION

The object of the invention is to furnish a high-pressure fuel reservoir of the type defined at the outset that has greater strength and a longer service than conventional high-pressure fuel reservoirs. Nevertheless, the high-pressure fuel reservoir of the invention should be simple in design, and it should be possible to produce it economically.

In a high-pressure fuel reservoir for a common rail fuel injection system of an internal combustion engine, having a plurality of connection openings, in particular connection openings for delivering and removing fuel and connection openings for sensors and valves and so forth, this object is attained in that the high-pressure fuel reservoir is equipped with a pulsation damping device. By means of the pulsation damping device, the volume of the high-pressure fuel reservoir can be reduced markedly. As a result, the harmonics that occur in operation are damped, and thus the high-pressure strength of the high-pressure fuel reservoir is increased.

A particular embodiment of the invention is characterized in that the pulsation damping device is formed by interference geometries. By means of the interference geometries, the propagation of pressure waves in the high-pressure fuel reservoir is at least hindered. The interference geometries can be embodied in various ways. It is possible for the interference geometries to be formed by separate parts. However, it is also possible for the interference geometries to be embodied integrally with the high-pressure fuel reservoir.

A particular embodiment of the invention is characterized in that the high-pressure fuel reservoir includes a housing with an inner chamber in which the interference geometries are received. The inner chamber can be formed by a bore, for instance. The bore can be embodied as a through bore or as a blind bore. The open end or ends of the bore can be closed with suitable closing elements, to make them high-pressureproof, after the interference geometry is inserted. Alternatively, the inner chamber can be formed by a spherical chamber. In the case of a spherical inner chamber, the insertion of the interference geometries is made possible by a two-part housing.

A further embodiment of the invention is characterized in that the interference geometries are formed by at least one twisted metal sheet, a shaft with pierced transverse walls disposed on it, a wire coil, at least one sheet-metal strip with perforations, and/or a tube with perforations. In designing the interference geometries, care must be taken that the volume of the high-pressure fuel reservoir not be greatly reduced by the interference geometries. In other words, interference geometries that are not/very voluminous are to be preferred.

A further embodiment of the invention is characterized in that the interference geometries protrude through the connection openings or through additional openings from outside into the inner chamber of the housing. The interference geometries can for instance be screwed or welded onto the outside of the high-pressure fuel reservoir. The distribution of interference geometries in the high-pressure fuel reservoir can be regular or irregular, as needed.

A further embodiment of the invention is characterized in that the pulsation damping device is formed by at least one escape piston, which is received, movable back and forth counter to a spring, in the high-pressure fuel reservoir. The escape piston makes active pulsation damping possible. Thus even better results can be obtained than with the passive pulsation damping described above.

A further embodiment of the invention is characterized in that the pulsation damping device is formed by at least one escape piston, which is received, movable back and forth counter to a spring, in at least one bush which is mounted on the high-pressure fuel reservoir. This embodiment offers the advantage that the mounting of the escape piston is simplified. Furthermore, this embodiment can also be employed in conventional high-pressure fuel reservoirs without special changes being made.

A further embodiment of the invention is characterized in that the escape piston is provided with a through hole. The through hole assures that a static pressure equalization can be effected between the regions of the high-pressure fuel reservoir or bush that are separated by the escape piston.

A further embodiment of the invention is characterized in that the side of the through bore toward the spring is equipped with a flow promoter. The flow promoter can for instance be a rounded feature or a countersunk feature. The other side of the through bore can be embodied with sharp edges. As a result, it is attained that the deflection motion of the piston, in the event of a pressure surge occurring in the high-pressure fuel reservoir, takes place counter to the spring.

A further embodiment of the invention is characterized in that the escape piston is prestressed by the spring against a stroke stop. As a result, it is attained that only pressure surges beyond a certain intensity will be damped, as a function of the pressure difference.

Further advantages, characteristics and details of the invention will become apparent from the ensuing description, taken with the drawings, in which.

DESCRIPTION OF THE PREFERRED EMBODIMENTS

Figure 1:
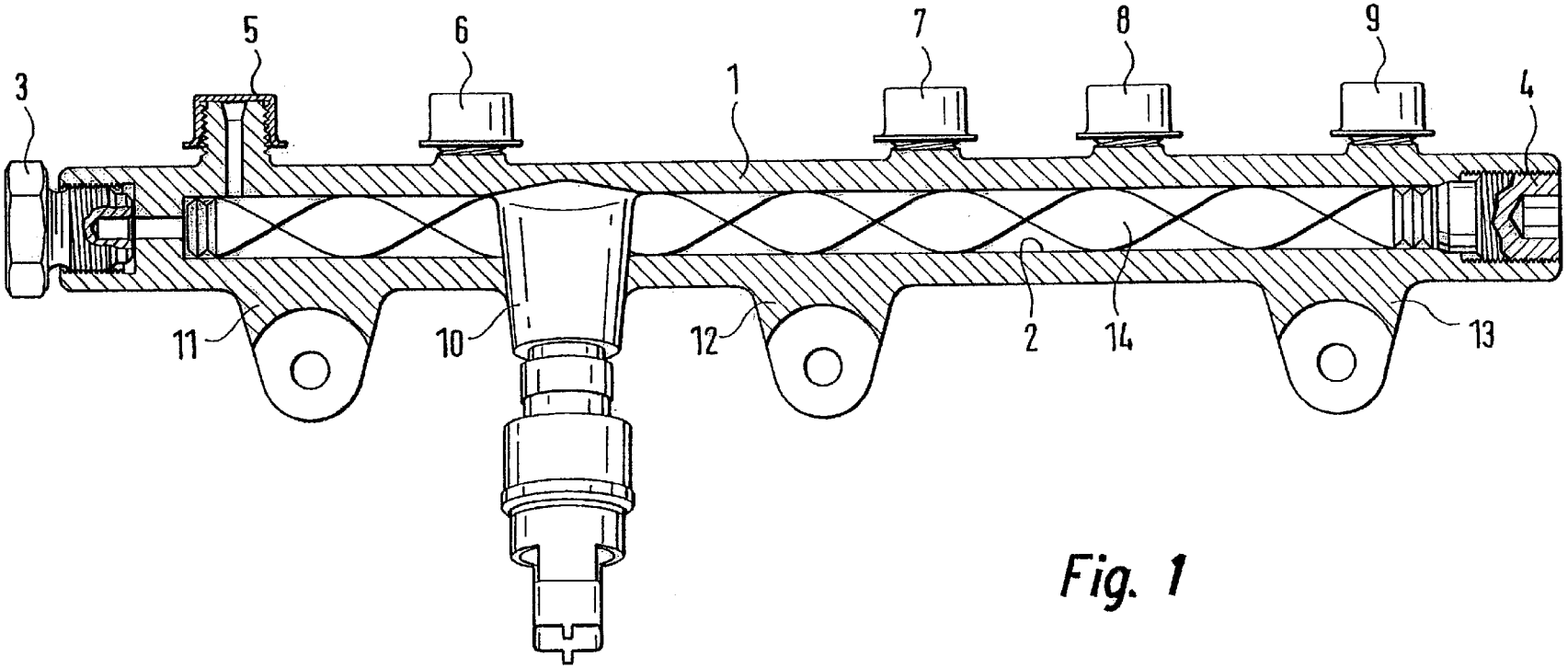
FIG. 1 is a longitudinal sectional view of a first embodiment of a high-pressure fuel reservoir of the invention.

In FIG. 1, a high-pressure fuel reservoir is shown that includes an elongated, tubular housing 1. In the tubular housing 1, a through bore 2 forms a storage chamber or reservoir for the fuel. The through bore 2 is closed so as to be high-pressureproof on both ends with the aid of closing stoppers or plugs 3 and 4. The housing 1 is also equipped with a number of connections 5–10. The connections 5–10 serve to connect the high-pressure fuel reservoir to the high-pressure pump and the individual injectors of an engine to be supplied. Also mounted on the housing 1 are a plurality of fastening elements 11–13, which serve to secure the high-pressure fuel reservoir to the engine.

A pulsation damping device 14 is fastened in the through bore 2 between the two closing screws 3 and 4. It is understood that the pulsation damping device 14 could also be fastened on only one side or could be braced radially.

Figure 2:
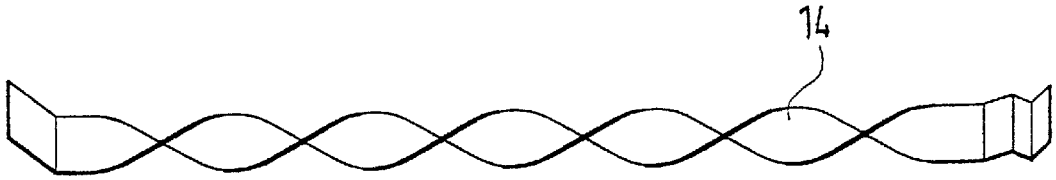
FIGS. 2–6 illustrates different variants of the pulsation damping device used in FIG. 1, shown separately in each case.

In FIGS. 2–6, different variants of the pulsation damping device 14 are shown. In FIG. 2, the pulsation damping device 14 of FIG. 1 is shown by itself. As can be seen, the pulsation damping device 14 is a twisted metal sheet.

Figure 3:
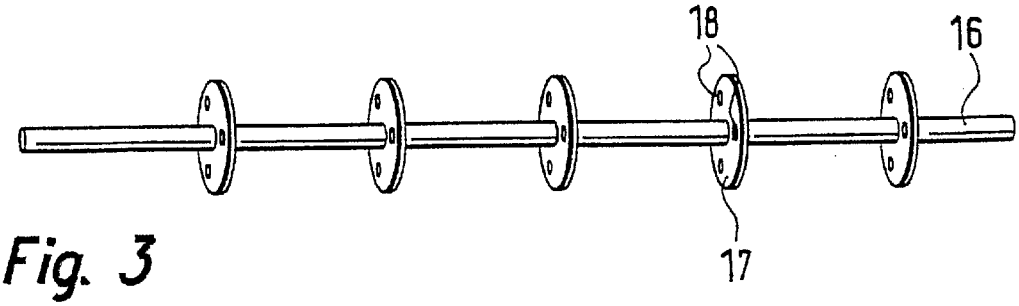

In FIG. 3, it can be seen that the pulsation damping device can also include a shaft 16, on which transverse walls or baffles 17 are disposed, spaced apart by equal intervals. To allow fuel to flow through, a plurality of perforations 18 are provided in the transverse walls 17.

Figure 4:
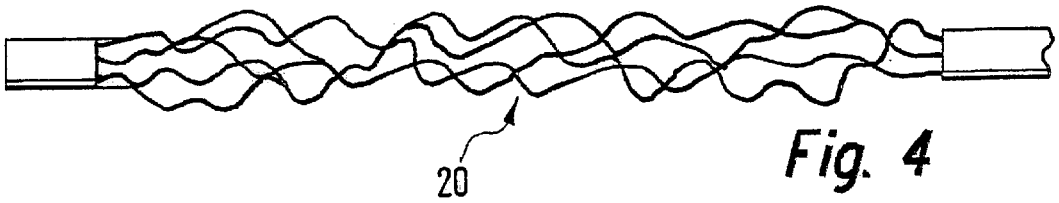

FIG. 4 shows a pulsation damping device that is formed by a wire coil 20. The wire coil 20 includes a plurality of wires, entwined irregularly with one another. Between individual wires, there is sufficient clearance to allow fuel to flow through.

Figure 5:
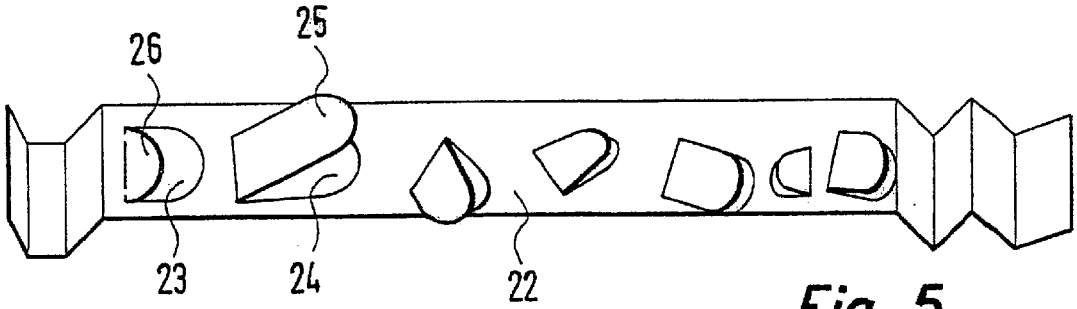

The pulsation damping device shown in FIG. 5 is formed by a sheet-metal strip 22, which is provided with a number of perforations, of which only two are provided in FIG. 5 with reference numerals 23 and 24, to serve as examples. The perforations 23 and 24 are formed by folding sheet-metal pieces 25 and 26 outward. The folded-out sheet-metal pieces 25 and 26 form guide vanes for the fuel located in the high-pressure fuel reservoir.

Figure 6:
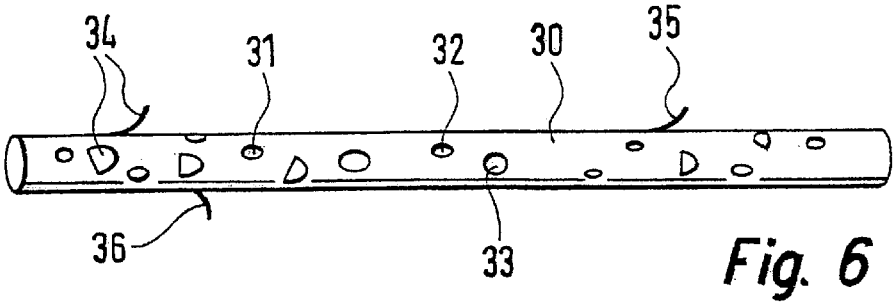

The pulsation damping device shown in FIG. 6 is formed by a sheet-metal tube 30. Many bores 31–33 are disposed in the tube 30. Many tabs 34–36 are also folded outward out of the jacket face of the tube 30. The bores 31–33 serve to allow fuel to flow through. The tabs 34–36 serve as guide vanes for the fuel.

Figure 7:
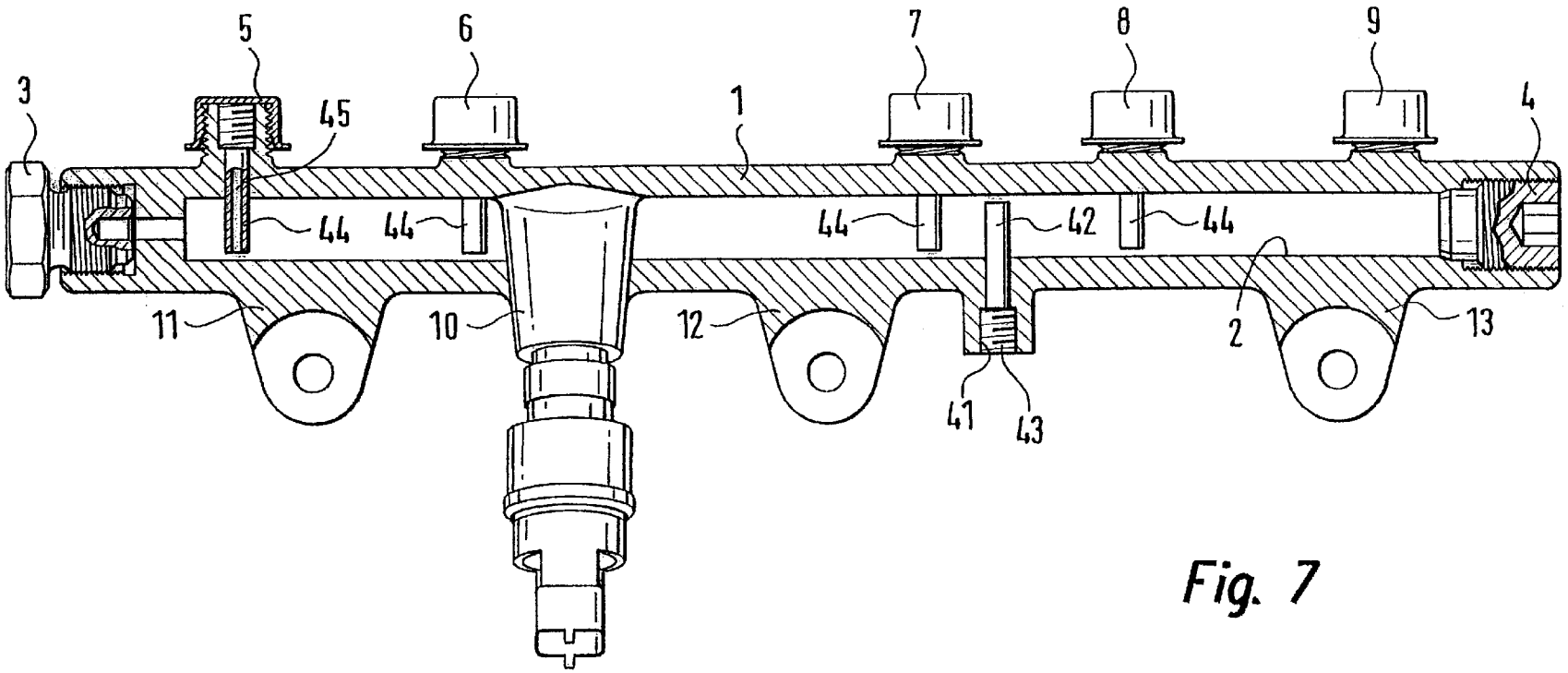
FIG. 7 is a view similar to FIG. 1 and showing a second embodiment of a high-pressure fuel reservoir of the invention.

The embodiment of a high-pressure fuel reservoir of the invention shown in FIG. 7 is largely equivalent to the embodiment shown in FIG. 1. For the sake of simplicity, the same reference numerals have therefore been used to designate identical parts. To avoid repetition, see the above description of the exemplary embodiment shown in FIG. 1.

In the embodiment shown in FIG. 7, the pulsation damping is achieved by a number of elongated damping elements, which protrude radially into the through bore 2. One of these elongated damping elements is formed by a pin 42, which is received in an additional connection opening 41. The pin 42 can be screwed, welded, soldered or fitted into the connection opening 41. On the outside, the connection opening 41 is closed in high-pressureproof fashion by a closing stopper 43. Pegs 44 are also received in the connection openings 5, 6, 7 and 8. Like the pin 42, the pegs 44 also protrude into the through bore 2. Unlike the pin 42, however, the pegs 44 are each equipped with an internal bore 45. The internal bore 45 allows fuel to flow through and thus makes the function of the connections 5, 6, 7 and 8 possible.

Figure 8:
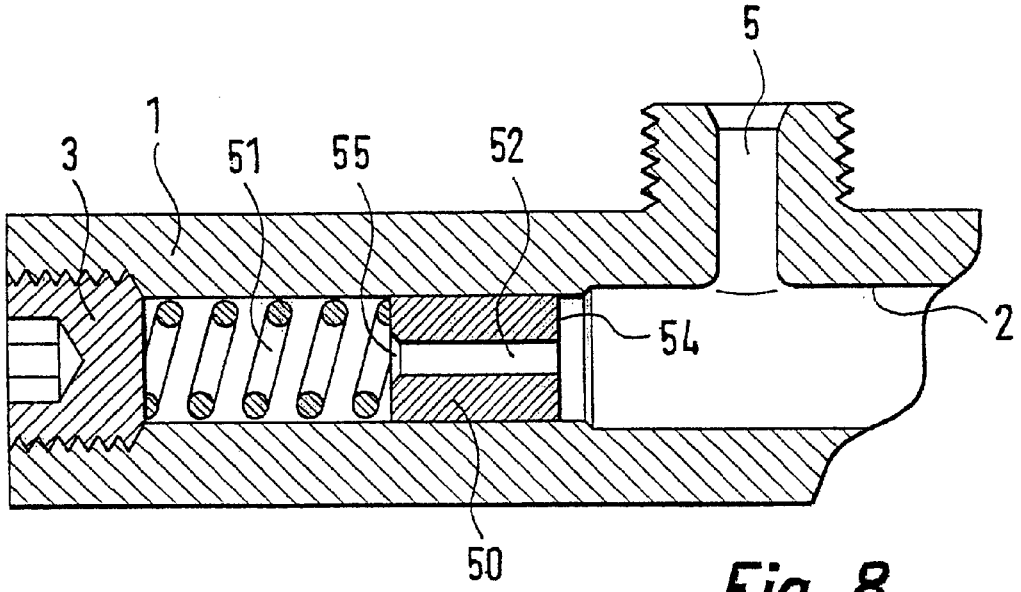
FIGS. 8–10 are each fragmentary sectional views of further embodiments of a high-pressure fuel reservoir of the invention.

In FIG. 8, only part of a tubular housing 1 of a further embodiment of a high-pressure fuel reservoir of the invention is shown in longitudinal section. The housing 1 has a through bore 2, which is closed on one end by a closing stopper 3. Via a plurality of connections, the through bore 2 communicates with a high-pressure pump and with the individual injectors. For the sake of simplicity, only one connection 5 is shown in FIG. 8.

An escape piston 50 is received, so that it can move back and forth, in the through bore 2. A spring 51 is disposed between the escape piston 50 and the closing stopper 3. The escape piston 50 is equipped with an axial through bore 52. On the end of the through bore 52 toward the spring 51, a countersunk feature 55 is provided. On the end remote from the spring 51, the through bore 52 is embodied with sharp edges. As a result, the flat annular surface 54 on the side remote from the spring 51 is somewhat larger than on the side with the countersunk feature 55.

By means of the through bore 52 in the escape piston 50, a static pressure equalization can be performed. The countersunk feature 55 at the inlet to the through bore 52 forms a flow promoter in one direction. Upon a pressure surge on the side of the escape piston 50 remote from the spring 51, the escape piston 50 is deflected counter to the force of the compression spring 51. The quantity of fuel located on the side of the spring is positively displaced through the through bore 52 to the side of the escape piston 50 remote from the spring 51.

Figure 9:
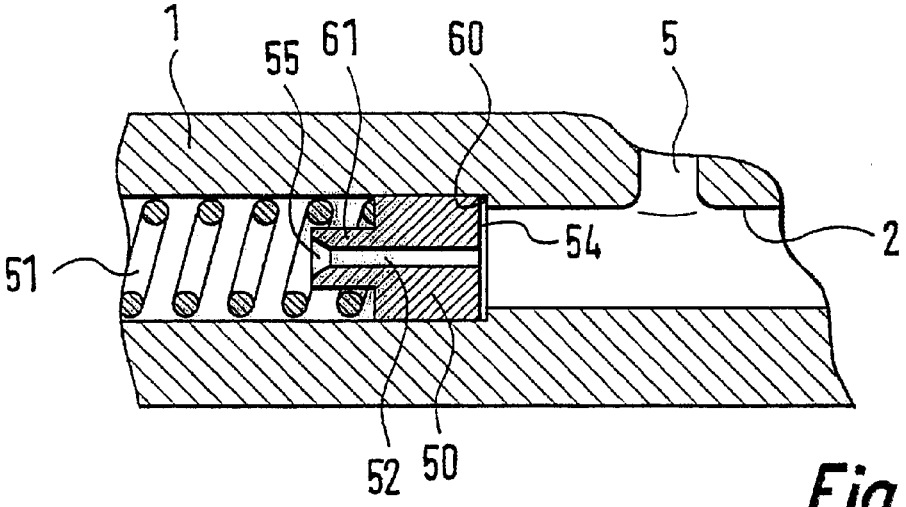

In the embodiment shown in FIG. 9, the escape piston 50 is in contact with a stroke stop 60. The spring 51 is also prestressed against the escape piston 50. In this embodiment, only pressure surges beyond a certain pressure difference are damped. In this embodiment, a guide 61 is also formed on the escape piston 50; it results from a reduction of the outside diameter of the escape piston 50.

Figure 10:
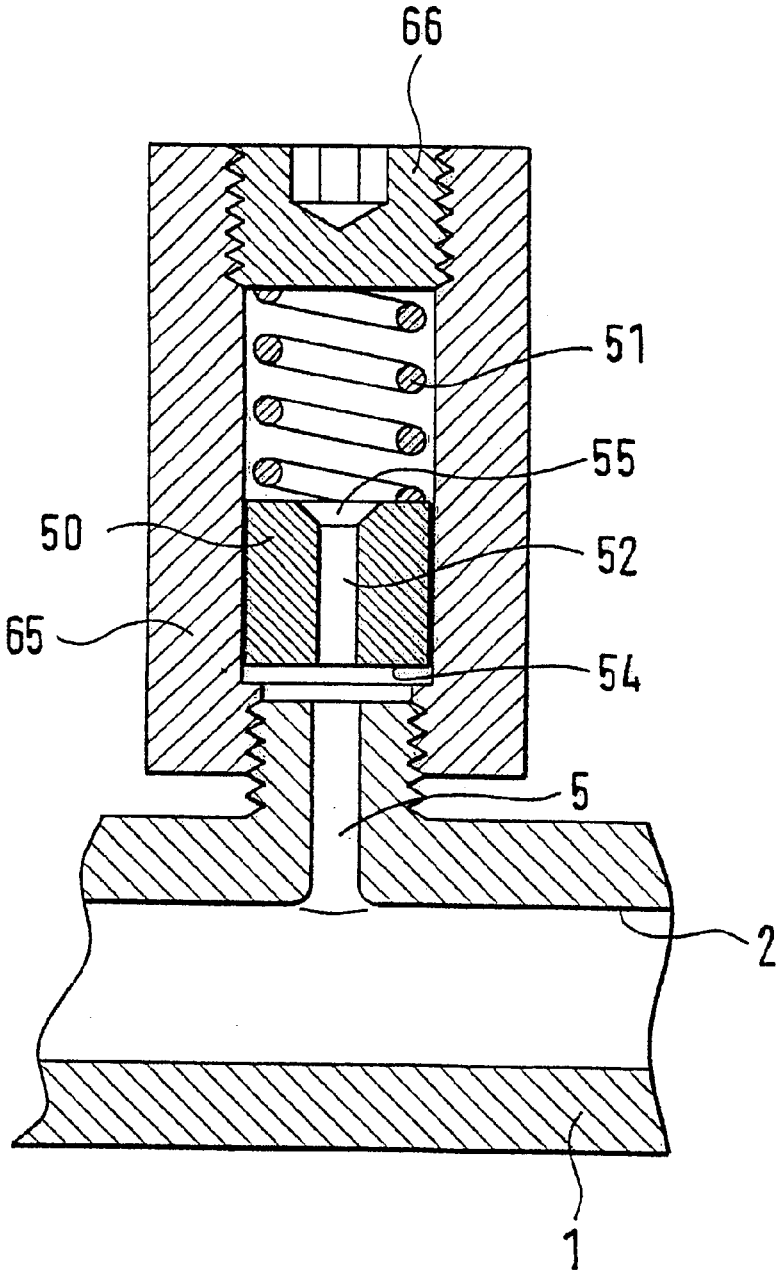

In the embodiment shown in FIG. 10, the pulsation damping device is integrated with a bush 65, which is screwed onto a connection 5 of the high-pressure fuel reservoir. By means of a closing stopper 66, the bush 65 is sealed off from the environment. An escape piston 50 is received, so as to be movable back and forth, in the bush 65. A compression spring 51 is located between the escape piston 50 and the closing stopper 66. Otherwise, the escape piston 50 functions exactly the same as the escape piston received in the through bore 2. Just like the escape piston describe above, the escape piston 50 shown in FIG. 10 has a through bore 52 with a countersunk feature 55.

The function of the pulsation damping device can be optimized with the parameters of pressure area, spring rigidity, spring prestressing, internal bore diameter, and rounding of the bore.

The foregoing relates to preferred exemplary embodiments of the invention, it being understood that other variants and embodiments thereof are possible within the spirit and scope of the invention, the latter being defined by the appended claims.

We claim:

1. A high-pressure fuel reservoir for a common rail fuel injection system of an internal combustion engine, said reservoir comprising a housing defining a pressure chamber, a plurality of connection openings (5–10) in the housing including, connection openings for delivering and removing fuel and connection openings for sensors and valves, and a pressure pulsation damping device (14) in the high-pressure fuel reservoir, wherein the pulsation damping device (14) is formed by interference geometries and wherein the interference geometries are formed by at least one twisted metal sheet (14), a shaft (16) with pierced transverse walls (17) disposed on it, at least one sheet-metal strip (22) with perforations (23, 24), and/or a tube (30) with perforations (31–33).

2. The high-pressure fuel reservoir of claim 1, wherein the high-pressure fuel reservoir includes a housing (1) with an inner chamber (2) in which the interference geometries are received.

3. A high-pressure fuel reservoir for a common rail fuel injection system of an internal combustion engine, said reservoir comprising a housing defining a pressure chamber, a plurality of connection openings (5–10) in the housing including, connection openings for delivering and removing fuel and connection openings for sensors and valves, and a pressure pulsation damping device (14) in the high-pressure fuel reservoir, wherein the pulsation damping device is formed by at least one escape piston (50) and a spring in the high pressure reservoir, the escape piston being movable back and forth counter to the spring (51) and wherein the escape piston (50) is provided with a through hole (52).

4. The high-pressure fuel reservoir of claim 3, wherein said pulsation damping device comprises at least one bush (65) mounted on the high-pressure fuel reservoir, said escape piston being movable counter to said spring in said bush.

5. The high-pressure fuel reservoir of claim 4, wherein the side of the through hole (52) toward the spring (51) further comprising a flow promoter (55).

6. The high-pressure fuel reservoir of claim 3, wherein the escape piston (50) is prestressed by the spring (51) against a stroke stop (60).

7. The high-pressure fuel reservoir of claim 3, wherein the side of the through hole (52) toward the spring (51) further comprising a flow promoter (55).

8. The high-pressure fuel reservoir of claim 4, wherein the side of the through hole (52) toward the spring (51) further comprising a flow promoter (55).

9. The high-pressure fuel reservoir of claim 4, wherein the escape piston (50) is prestressed by the spring (51) against a stroke stop (60).

10. The high-pressure fuel reservoir of claim 5, wherein the escape piston (50) is prestressed by the spring (51) against a stroke stop (60).

* * * * *